US006315517B1

(12) United States Patent
Nonaka et al.

(10) Patent No.: US 6,315,517 B1
(45) Date of Patent: Nov. 13, 2001

(54) VACUUM PUMP

(75) Inventors: Manabu Nonaka; Akira Yamauchi, both of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/426,530

(22) Filed: Oct. 26, 1999

(30) Foreign Application Priority Data

Oct. 28, 1998 (JP) ..... 10-306826
Mar. 31, 1999 (JP) ..... 11-093583

(51) Int. Cl.[7] ..... F01D 1/36; F03B 5/00

(52) U.S. Cl. ..... 415/72; 415/73; 415/75; 415/90

(58) Field of Search ..... 415/72, 73, 75, 415/90, 168.3; 416/176, 177; 417/423.4

(56) References Cited

U.S. PATENT DOCUMENTS 2,957,423 * 10/1960 Audemar ..... 415/90
3,667,276 * 6/1972 Moodey ..... 416/176
3,884,451 * 5/1975 Stenmark et al. ..... 416/176
3,913,897 * 10/1975 Hanslik ..... 415/72
5,120,208 6/1992 Toyoshima et al. .

FOREIGN PATENT DOCUMENTS 4129673 3/1993 (DE) .
63-85288 * 4/1988 (JP) .

* cited by examiner

*Primary Examiner*—Christopher Verdier
(74) *Attorney, Agent, or Firm*—Adams & Wilks

(57) ABSTRACT

A vacuum pump comprises an inlet port into which a gas is introduced, an outlet port from which the gas is discharged, a stator, a motor, and a rotor opposing the stator and driven by the motor to undergo rotation to cooperate with the stator to force the gas from the inlet port to the outlet port. The rotor has a body, a spiral thread disposed on the body, and a thread groove disposed between adjacent lines of the spiral thread. An axial length of the spiral thread is shorter than an axial length of the rotor so that a terminal end portion of the spiral thread terminates short of an axial end of the rotor. The terminal end portion of the spiral thread slopes inward toward a surface portion of one of the thread grooves. A junction surface between a terminal end portion of the slope of the spiral thread and the surface portion of the thread groove forms a recessed portion.

13 Claims, 8 Drawing Sheets

VACUUM PUMP

BACKGROUND OF THE INVENTION

1. Field of the Invention

The present invention relates to a vacuum pump for evacuating a vacuum chamber, and more particularly to an improvement of the vacuum pump in which a rotor arranged inside has a threaded portion on the surface thereof.

2. Description of the Related Art

Vacuum pumps are used, for example, as vacuum producing apparatus for exhausting gas within a chamber of semiconductor manufacturing equipment, so at to discharge a process gas supplied to the chamber for processing the semiconductor devices therein.

FIG. 5 shows the overall structure of the vacuum pump. In FIG. 5, reference numeral 101 denotes a casing in which a gas inlet port 102 and a gas outlet port 103 are formed. A rotor 104 is housed in the casing 101. Formed on this rotor 104 are a plurality of rotor blades 105 projecting outwardly in a radial direction toward the inner circumferential wall of the casing 101, and a threaded portion 108 disposed below the rotor blades 105 and having spiral thread grooves formed therein.

A plurality of stator blades 106 and a stator 109 are attached to the inner circumferential wall of the casing 101 facing the rotor blades 105 and the threaded portion 108, respectively. The rotor 104 is rotated by a motor 107 housed in the casing 101, which causes the rotor blades 105 and the threaded portion 108 to rotate at a high-speed relative to the stator blades 106 and the stator 109, respectively.

A stator blade 106 and a stator 109 are attached onto the inner circumferential wall of the casing 101 while facing with the rotor blade 105 and the threaded portion 108, respectively. The rotor 104 is rotated by a motor 107 housed in the casing 101, which causes the rotor blade 105 and the threaded portion 108 to rotate at a high-speed relative to the stator blade 106 and the stator 109, respectively.

The rotor 104 is fixedly provided with a rotor shaft 112 and is rotatably floated by magnetic force produced by an axial electromagnet 113 and a radial electromagnet 114. Further, touch down bearings 115 and 116 are provided in an outer member of the rotor shaft 112 so as to come in contact with the rotor shaft 112 and to rotatably support the same in the case where the rotor shaft 112 is floated, but is not supported through magnetic force by the electromagnets 113 and 114.

However, a conventional vacuum pump constructed as described above has structural defects. As shown in FIG. 6, a terminal end face, which is located on the downstream gas suction side (lower end in the drawing), of a thread 108*a* in the threaded portion 108 is formed so as to be identical with the end face of the rotor 104 on the downstream gas suction side (lower end in the drawing). A thread groove 108*b* is formed axially between two adjacent lines of thread 108*a*, which is formed by machining with an edge tool to have a sharply gouged bottom corner. Such structure causes the centrifugal force upon rotation of the rotor 104 to tend to concentrate stress on the bottom corner of the thread groove 108*b*.

In particular, a bottom corner C (see FIG. 7) of the thread groove 108*b*, located at a terminal B of the thread 108*a* in FIG. 6, is at a location at which the edge tool is pulled out upon completing the machining. Accordingly, a notch is liable to be produced due to imbalance in machining resistance. For this reason, the bottom corner C is liable to start a crack to eventually damage the rotor 104 with the centrifugal force upon rotation.

To solve the above-mentioned problem, there is known a vacuum pump having a rotor in which the spiral thread is provided on the surface of the rotor so as to project with a thread groove that is axially formed between two adjacent lines of the thread. In this vacuum pump, the position of the terminal end face of the thread on the downstream gas suction side is shifted so that it becomes shorter than the end face of the rotor on the downstream gas suction side, and a recessed R portion is formed at the root of the terminal end face of the thread on the downstream gas suction side.

FIG. 8 is a side view of the end portion of the rotor. In FIG. 8, reference numeral 4 denotes the rotor of the vacuum pump. A spiral thread 4*a* is formed projectingly on the surface of this rotor 4 so that a thread groove 4*b* is formed axially between two adjacent lines of the thread 4*a*. At the lower end portion of the rotor 4 in the drawing (the end portion on the downstream gas suction side), the position of a terminal face 40 of the thread 4*a* on the downstream gas suction side is shifted so as to be shorter by a length H than the position of an end face 41 of the rotor 4 on the downstream gas suction side.

For this reason, at a bottom corner of the thread groove 4*b* at the end portion of the downstream gas suction side of the thread 4*a*, even if a notch is produced when an edge tool is pulled out upon completing the machining, due to imbalance in machining resistance, if, thereafter, the end portion of the thread 4*a* on the downstream gas suction side is scraped by H so that the downstream gas suction side terminal face 40 of the thread 4*a* is shifted to position to reach short of the downstream gas suction side end face 41 of the rotor 4, it is capable of scraping off the notch, too, caused by the imbalance of machining resistance, thereby being capable of, unlike conventional pumps, preventing formation of a crack developed from the notch, which may cause damage to the rotor with the centrifugal force upon rotation.

In the vacuum pump with such a structure, the downstream gas suction side terminal face of the thread is shifted so as to reach short of the end face of the rotor on the downstream gas suction side. Therefore, even if a notch is produced at the bottom corner of the thread groove at the downstream gas suction side terminal face of the thread by an edge tool pulled out upon completing the machining, due to imbalance in machining resistance, if, thereafter, the end portion of the thread on the downstream gas suction side is scraped a little so that the downstream gas suction side terminal face of the thread is shifted to reach short of the downstream gas suction side end face of the rotor, it is capable of scraping off the notch, too, caused by the imbalance of machining resistance, and further, by finishing the root of the downstream gas suction side terminal of the thread into a shape of a recess R, it is capable of preventing the concentration of stress on the root, thereby being capable of preventing damage to the rotor due to a crack developed from the notch by the centrifugal force upon rotation.

However, even this device, having the thread near the rotor end, is not free from a problem of concentration of bending stress at the thread terminal, which is stress concentration on the thread root caused by a difference in thickness between the portions with thread and without thread.

SUMMARY OF THE INVENTION

The present invention has been made to solve such problems.

To attain the above object, according to an object of the present invention, there is provided a vacuum pump having a rotor with a spiral thread projecting on its surface, wherein an axial length of the thread is shorter than that of the rotor and the terminal portion of the thread slopes down or inward toward the surface of the thread groove.

The junction face between the terminal portion of the slope of the thread and the surface of the thread groove forms a recessed R portion.

The vacuum pump with the structure described above can abate stress concentration on the thread root caused by a difference in thickness between the portions with and without the thread, especially at the thread terminal portion on which bending stress is concentrated, and can prevent the damage to the rotor.

DESCRIPTION OF THE PREFERRED EMBODIMENT

Hereinafter, a description will be made of various embodiments of the present invention with reference to the drawings.

Figure 1:
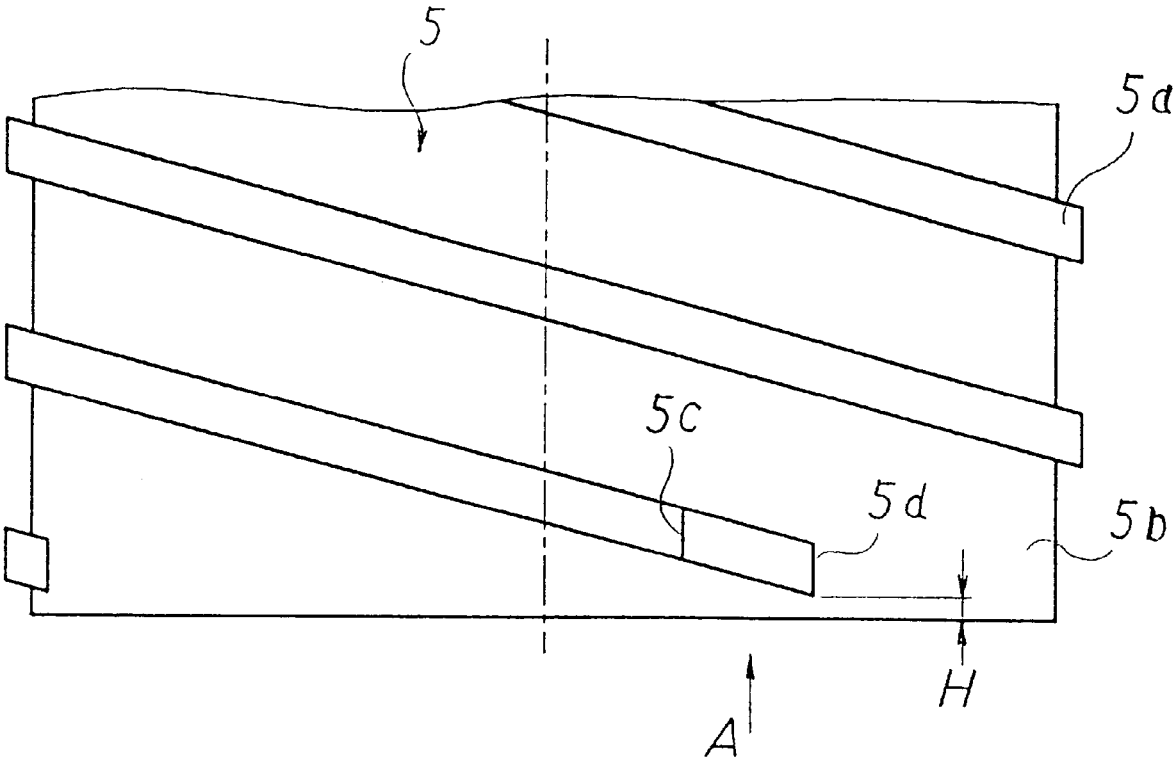
FIG. 1 is a view illustrating Embodiment 1 of the present invention.
Figure 2:
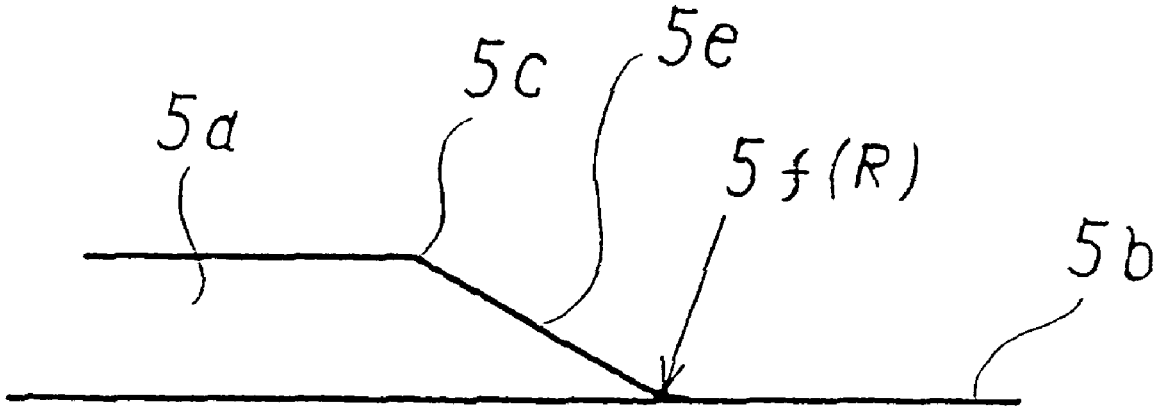
FIG. 2 is a view viewed from a direction indicated by an arrow A in FIG. 1.

FIG. 1 is a view showing a main part of a vacuum pump according to an embodiment of the present invention, and FIG. 2 is an illustration of the pump as viewed from a direction indicated by an arrow A in FIG. 1. As to the structure identical with that of the conventional vacuum pump described above.

In the drawings, reference numeral 5 denotes a rotor of the vacuum pump. A spiral thread 5*a* is projectingly formed on the surface of the rotor 5, with a thread groove 5*b* formed axially between two adjacent lines of the thread. At the lower end of the rotor 5 in the drawing (the end on the downstream gas suction side), the downstream gas suction side terminal face of the thread 5*a* is shifted to reach short, by a length H, of the downstream gas suction side end face of the rotor 5.

Further formed is a slope 5*e* along which the height of the thread 5*a* at a thread terminal portion 5*d* is decreased to level with the thread groove portion 5*b*, the slope 5*e* having as the starting line an arbitrary position 5*c*.

In the vacuum pump with this structure, the slope 5*e* is formed so as to level the height of the thread 5*a* with the thread groove portion 5*b* at the thread terminal portion 5*d* of the thread 5*a* on the downstream gas suction side, where bending stress is concentrated most. Stress concentration on the root of the thread, which is caused by the thickness difference between portions with and without thread, is thus abated, thereby preventing damage to the rotor due to the crack.

Further, as shown in FIG. 2, the junction surface between the downstream gas suction side terminal portion 5*d* of the thread 5*a* and the thread groove portion 5*b* may form a recessed R portion 5*f*. The portion 5*f* serves to prevent more securely the stress concentration on the downstream gas suction side terminal portion 5*d* of the thread 5*a* and enhance the strength, so that damage to the rotor resulting from the crack by centrifugal force upon rotation can be prevented.

Figure 3:
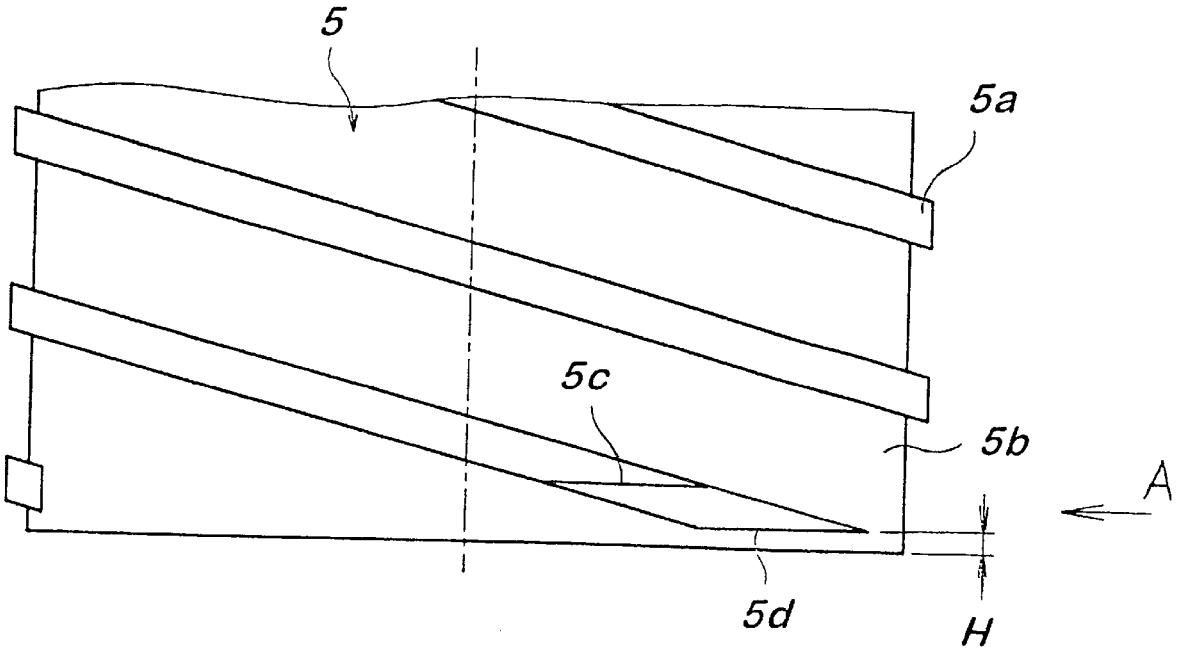
FIG. 3 is a view illustrating Embodiment 2 of the present invention.
Figure 4:
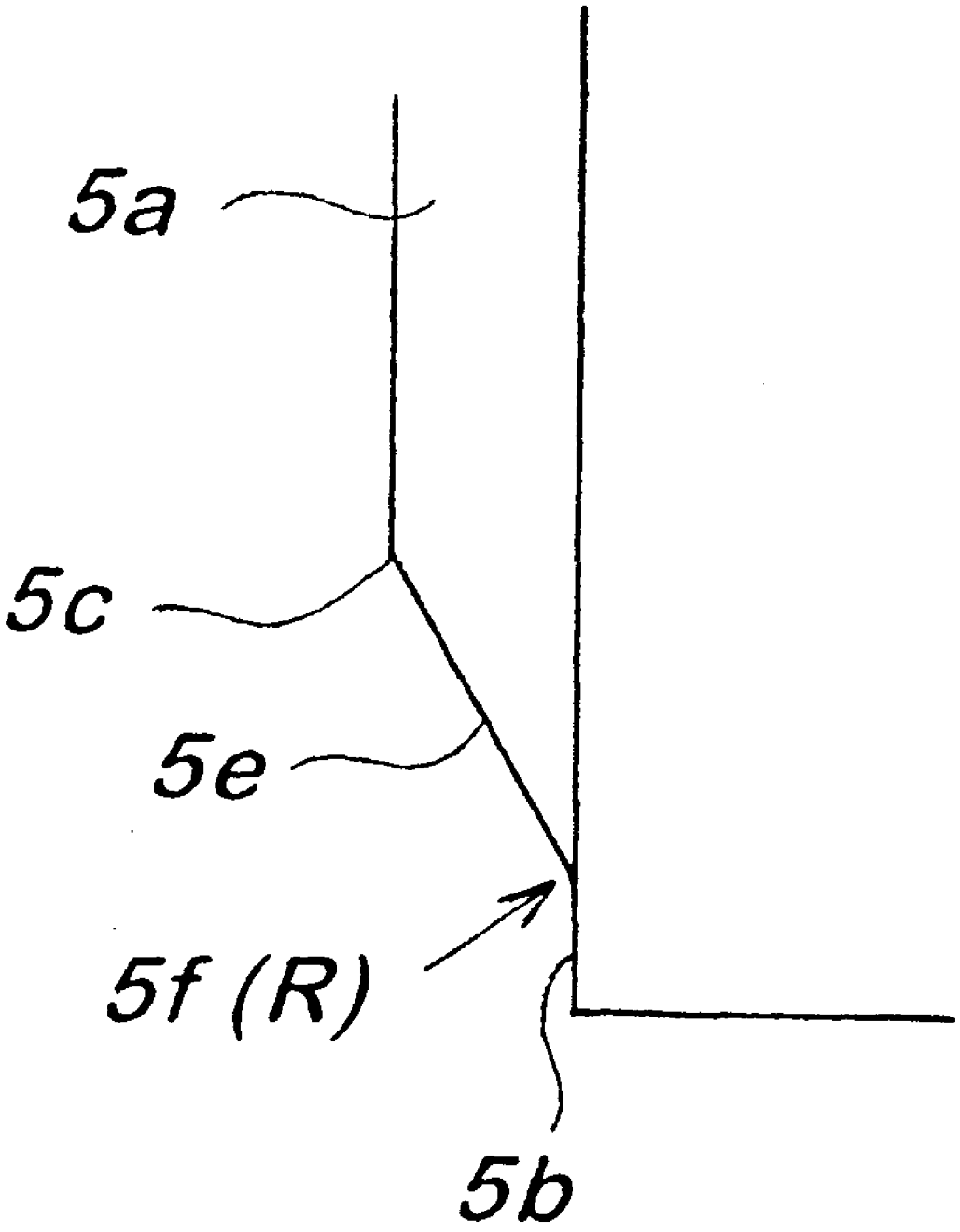
FIG. 4 is a view viewed from a direction indicated by an arrow A in FIG. 3.
Figure 5:
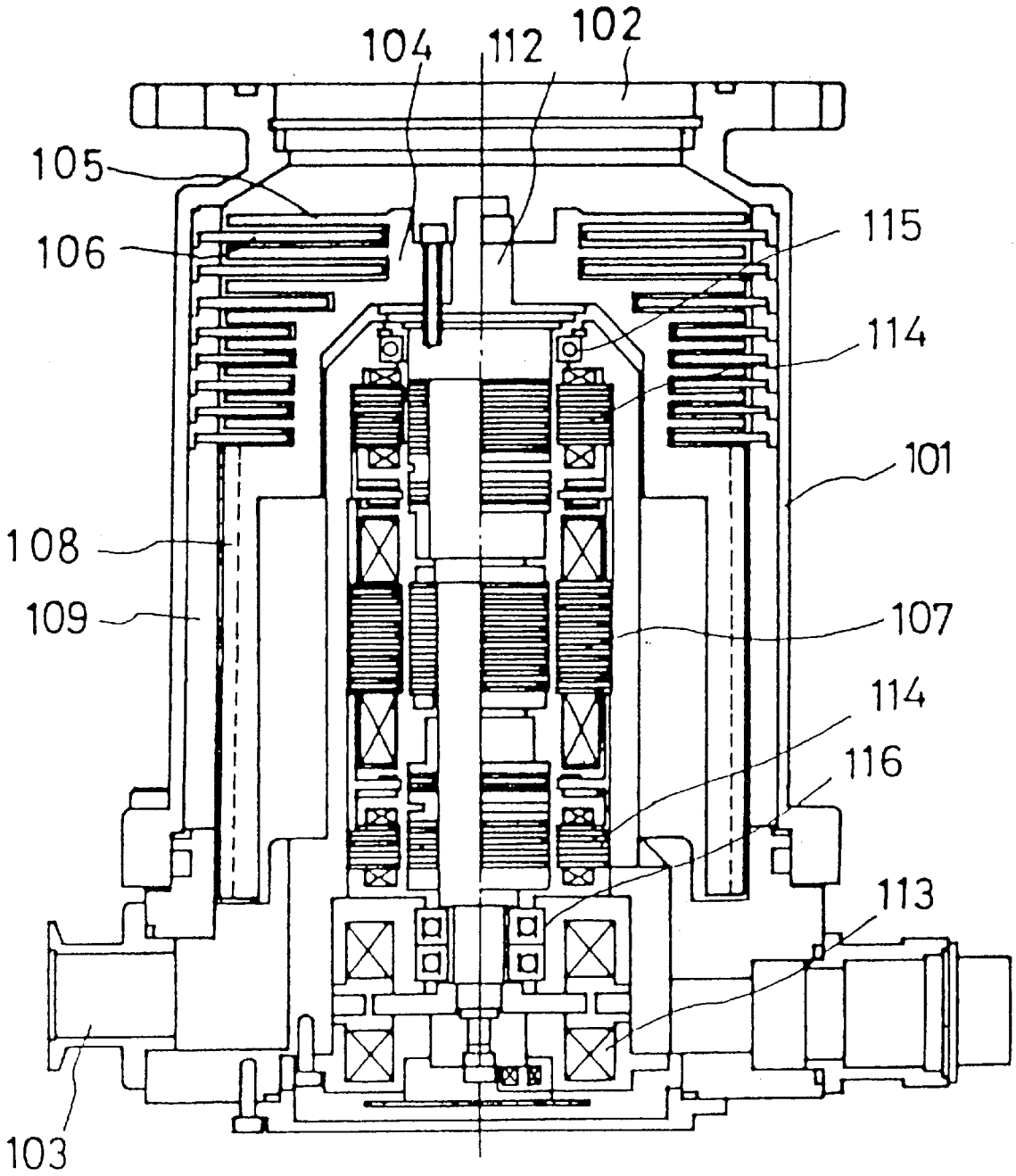
FIG.5 PRIOR ART
FIG. 5 is a view showing cross-section of a conventional. vacuum pump.
Figure 6:
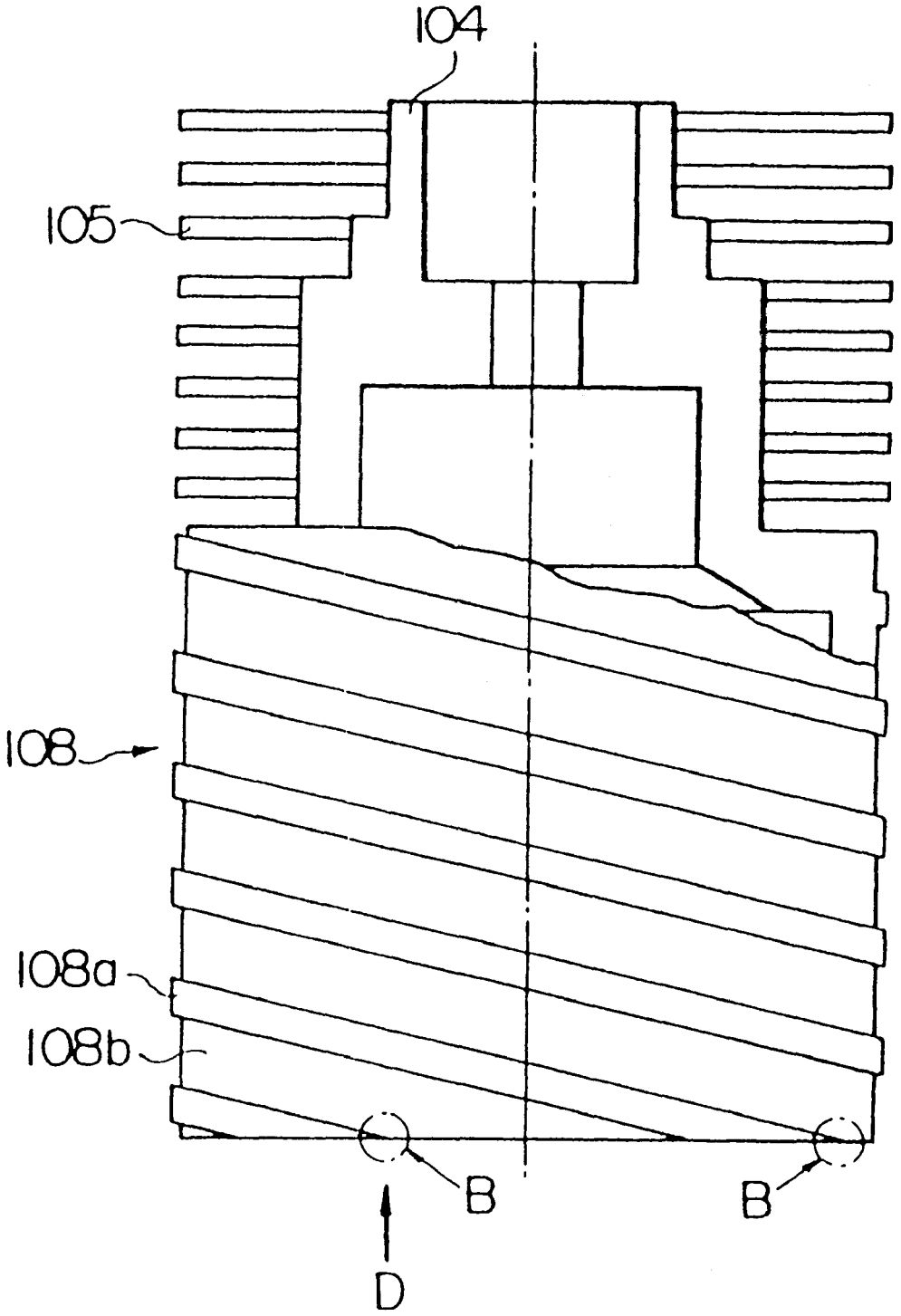
FIG.6 PRIOR ART
FIG. 6 is a partially cross-sectional side view showing the conventional vacuum pump.
Figure 7:
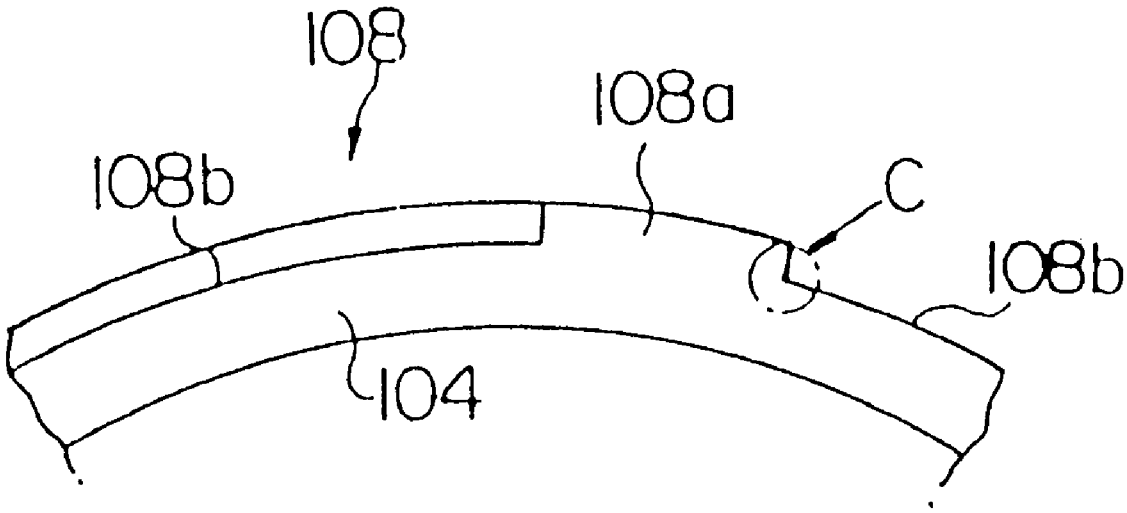
PRIOR ART FIG. 7
FIG. 7 is a view viewed from a direction indicated by an arrow D in FIG. 6.
Figure 8:
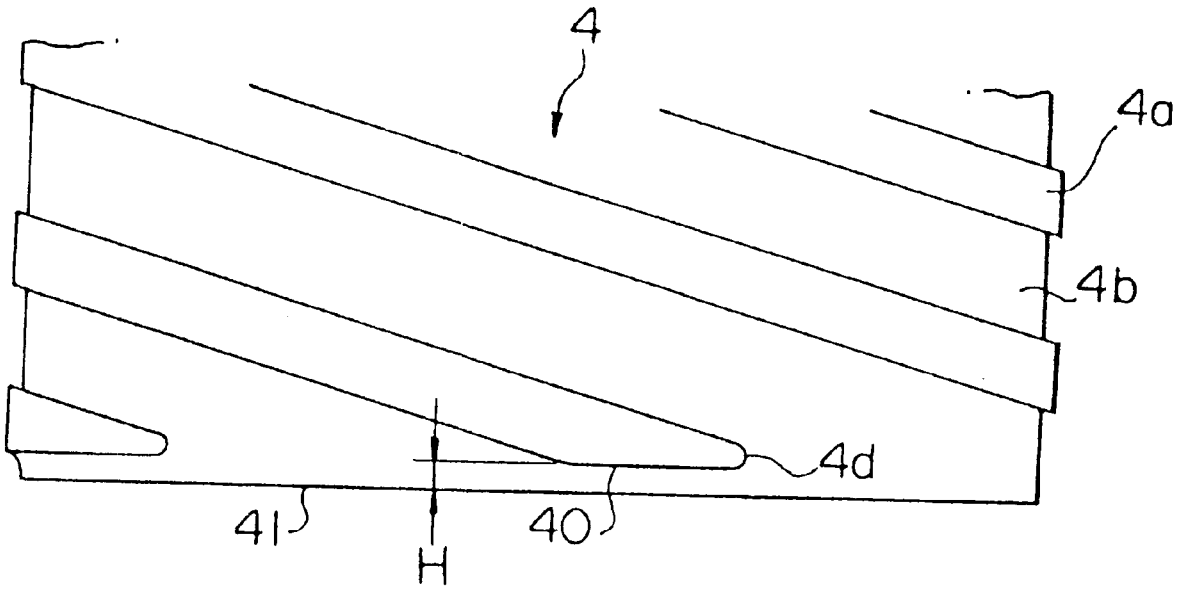
FIG.8 PRIOR ART
FIG. 8 is a partially cross-sectional side view showing another conventional vacuum pump.

FIG. 3 is a view showing the main part of a vacuum pump in another embodiment according to the present invention, and FIG. 4 is a view viewed from a direction indicated by an arrow A in FIG. 3. In comparison with the embodiment illustrated in FIGS. 1 and 2, the slope 5*e* in FIGS. 3 and 4 is in a different direction, and the starting line 5*c* of the slope 5*e* in this embodiment is at right angles with the axial direction of the rotor.

In the above embodiment, the recessed R portion 5*f* is provided only at the downstream gas suction side terminal portion 5*d* of the thread 5*a*. However, the embodiment may be modified and all the lines of the thread 5*a* may have recessed R portions at their side roots.

Also, it is understood that the present invention may be applied to a thread-groove type vacuum pump, which has only threads and grooves and no blade, as well as to a conventional turbomolecular pump of a composite type.

As described above, according to the present invention, the downstream gas suction side terminal face of the thread is shifted to position to reach short of the downstream gas suction side end face of the rotor, and the slope is provided to level the height of the thread with the groove surface at the terminal portion of the thread. Therefore, at the thread terminal portion on which bending stress by centrifugal force upon the rotor rotation is concentrated, damage to the rotor due to stress concentration caused by thickness difference between the portions with and without thread may be prevented.

What is claimed is:

1. A vacuum pump comprising: an inlet port into which a gas is introduced; an outlet port from which the gas is discharged; a stator; a motor; and a rotor opposing the stator and driven by the motor to undergo rotation to cooperate with the stator to force the gas from the inlet port to the outlet port, the rotor having a body, a spiral thread disposed on the body, and a thread groove disposed between adjacent lines of the spiral thread, an axial length of the spiral thread being shorter than an axial length of the rotor so that a terminal end portion of the spiral thread terminates short of an axial end of the rotor, the terminal end portion of the spiral thread sloping inward toward a surface portion of one of the thread grooves, and a junction surface between a terminal end portion of the slope of the spiral thread and the surface portion of the thread groove forming a recessed portion.

2. A vacuum pump according to claim 1; wherein the slope of the terminal end portion of the spiral thread terminates before it reaches the axial end of the rotor so that a space is provided between the axial end of the rotor and the terminal end portion of the thread.

3. A vacuum pump according to claim 1; wherein the slope of the terminal end portion of the spiral thread extends inward toward the surface portion of the thread groove in the axial direction of the rotor.

4. A vacuum pump according to claim 1; wherein the slope of the terminal end portion of the spiral thread extends inward toward the surface portion of the thread groove in a direction perpendicular to the axial direction of the rotor.

5. A vacuum pump comprising: a casing having an inlet port into which a gas is introduced by vacuum suction and an outlet port from which the gas is discharged; a rotor rotatably received in the casing so that a first axial end of the rotor is disposed proximate the inlet port and a second axial end opposite the first is disposed proximate the outlet port, the rotor having a plurality of rotor blades separated from each other in an axial direction of the casing, a spiral thread projecting from a surface of the rotor, and a spiral thread groove formed between adjacent lines of the spiral thread, the spiral thread terminating short of the second axial end of the rotor and having a terminal portion sloping inward toward a surface of the thread groove, and a junction surface between a terminal end of the sloping terminal portion of the spiral thread and the surface portion of the thread groove forming a recessed portion; a motor disposed in the casing for rotatably driving the rotor; and a stator disposed in the casing opposite the rotor and having a plurality of stator blades arranged between respective ones of the rotor blades so that rotational movement of the rotor causes a gas introduced at the inlet port to be transported by the rotor blades in an axial direction of the rotor away from the inlet port and toward the outlet port.

6. A vacuum pump according to claim 5; wherein the slope of the terminal portion of the spiral thread extends inward toward the surface of the thread groove in the axial direction of the rotor.

7. A vacuum pump according to claim 5; wherein the slope of the terminal portion of the spiral thread extends inward toward the surface of the thread groove in a direction perpendicular to the axial direction of the rotor.

8. A vacuum pump according to claim 5; wherein the slope of the terminal portion of the spiral thread terminates before it reaches the second axial end of the rotor so that a space is provided between the axial end of the rotor and a terminal end of the thread.

9. A vacuum pump according to claim 5; wherein the recessed portion at the junction surface between the terminal end of the slope of the terminal portion of the spiral thread and the surface of the thread groove has a preselected radius of curvature.

10. A vacuum pump comprising: a casing having an inlet port into which a gas is introduced by vacuum suction and an outlet port from which the gas is discharged; a rotor disposed in the casing for undergoing rotation, the rotor having a first axial end disposed closer to the inlet port than the outlet port, a second axial end disposed closer to the outlet port than the inlet port, a plurality of rotor blades extending from a surface of the rotor, a spiral thread projecting from the surface of the rotor, and a spiral thread groove formed between adjacent lines of the spiral thread, the spiral thread terminating short of the second axial end and having a terminal portion sloping inward toward a surface of the thread groove, and a junction surface between a terminal end of the sloping terminal portion and the surface portion of the thread groove having a preselected radius of curvature for reducing stress concentrations; and a stator disposed in the casing and having a plurality of stator blades arranged between respective ones of the rotor blades so that rotational movement of the rotor causes a gas introduced at the inlet port to be transported by the rotor blades in an axial direction of the rotor away from the inlet port and toward the outlet port.

11. A vacuum pump according to claim 10; wherein the slope of the terminal portion of the spiral thread extends inward toward the surface of the thread groove in the axial direction of the rotor.

12. A vacuum pump according to claim 10; wherein the slope of the terminal portion of the spiral thread extends inward toward the surface of the thread groove in a direction perpendicular to the axial direction of the rotor.

13. A vacuum pump according to claim 10; wherein the slope of the terminal portion of the spiral thread terminates before it reaches the second axial end of the rotor so that a space is provided between the axial end of the rotor and a terminal end of the thread.

* * * * *